US008424726B2

(12) United States Patent
McClurg

(10) Patent No.: US 8,424,726 B2
(45) Date of Patent: Apr. 23, 2013

(54) REUSABLE SEALING APPARATUS FOR CONTAINERS OF EXTRACTABLE MATERIAL

(76) Inventor: Ben Bruce McClurg, Lake Oswego, OR (US)

( * ) Notice: Subject to any disclaimer, the term of this patent is extended or adjusted under 35 U.S.C. 154(b) by 45 days.

(21) Appl. No.: 13/079,670

(22) Filed: Apr. 4, 2011

(65) Prior Publication Data

US 2011/0240686 A1 Oct. 6, 2011

Related U.S. Application Data

(60) Provisional application No. 61/456,003, filed on Oct. 29, 2010, provisional application No. 61/341,737, filed on Apr. 5, 2010.

(51) Int. Cl.
*B67D 1/08* (2006.01)

(52) U.S. Cl.
USPC ..... 222/151; 222/546; 222/563

(58) Field of Classification Search ..... 222/149, 222/151, 546, 552, 563; 215/320
See application file for complete search history.

(56) References Cited

U.S. PATENT DOCUMENTS 537,888 A * 4/1895 Chase ..... 222/151
3,204,835 A * 9/1965 Michel ..... 222/541.5
3,406,875 A * 10/1968 Park ..... 222/151
3,578,224 A * 5/1971 Greenhut ..... 222/546
3,930,599 A * 1/1976 Brothers et al. ..... 222/143
4,213,546 A * 7/1980 Massey ..... 222/546
4,328,910 A * 5/1982 Polite, Jr. ..... 222/81
4,390,115 A * 6/1983 Bigham ..... 222/326
4,669,635 A 6/1987 Brookhart
5,154,327 A * 10/1992 Long ..... 222/326
5,248,071 A 9/1993 Ray
5,295,601 A * 3/1994 Bostelman ..... 220/287
5,799,829 A * 9/1998 Lier et al. ..... 222/83
6,223,957 B1 5/2001 Hoppe
6,481,597 B1 11/2002 Cermak, III
6,550,644 B2 * 4/2003 Cruddas ..... 222/83
2004/0226968 A1 11/2004 Lafond
2005/0236441 A1 10/2005 Martin

OTHER PUBLICATIONS

Prazi USA, "Seal-a-Tube", Tube Saver label, publication date unknown, 1 page.
Prazi USA, "Seall-a-Tube", http://praziusa.com/sealatube.htnnl, accessed Mar. 21, 2011, publication date unknown, 1 page.
Google, "Prazi Seal a Tube", Google Search, accessed Mar. 31, 2009, 1 page.
"How to Preserver Silicon Caulk in Tube", Decoden Sweets Deco Miniature Tutorials, http://kawaiifrenzy.com, accessed Mar. 10, 2010, publication date unknown, 1 page.

* cited by examiner

*Primary Examiner* — Kevin P Shaver
*Assistant Examiner* — Daniel R Shearer
(74) *Attorney, Agent, or Firm* — Kolisch Hartwell, PC

(57) ABSTRACT

A reusable sealing apparatus for use with a container of an extractable material, the container including a nozzle. The apparatus may include a first sealing member, a second sealing member and a body member including a cavity configured to fit over a portion of a distal end of a nozzle, the body member positioned between the first sealing member and the second sealing member. The apparatus may further include a core member including an insertion tip and an elongate portion, wherein the elongate portion may extend through the body member and at least one of the first sealing member and second sealing member. The first sealing member, the body member and the second sealing member together may substantially seal a nozzle.

20 Claims, 2 Drawing Sheets

REUSABLE SEALING APPARATUS FOR CONTAINERS OF EXTRACTABLE MATERIAL

This application claims the benefit of priority under 35 U.S.C. §119(e) of U.S. Provisional Patent Application Ser. No. 61/341,737, titled PIERCE AND SEAL, filed Apr. 5, 2010; and U.S. Provisional Patent Application Ser. No. 61/456,003, titled TUBE PRODUCT SEALER, filed Nov. 1, 2010; both of which are incorporated herein by reference in their entirety for all purposes.

BACKGROUND

The present disclosure relates generally to closures for containers of extractable material. Specifically, the present disclosure relates to a reusable sealing apparatus for use with a container of extractable material, such as adhesives, epoxies, sealants, including caulking, pastes, lubricants and other viscous materials.

Containers of extractable material are being wasted and/or thrown away because of unnecessary drying out of the extractable material within the container. In typical use, a user may create an opening in a new container, for example by cutting off the tip of a nozzle attached to the container. The container may be used once and then stored. During storage, the extractable material may partially or completely dry out, the opening may become plugged with the material and/or the container may otherwise become unusable due to improper sealing of the container after use. As a result, the entire container must be thrown out, creating a waste of material and money.

SUMMARY

The present disclosure provides a reusable sealing apparatus for use with a container of an extractable material, the container including a nozzle. The apparatus may include a first sealing member, a second sealing member and a body member including a cavity configured to fit over a portion of a distal end of a nozzle, the body member positioned between the first sealing member and the second sealing member. The apparatus may further include a core member including an insertion tip and an elongate portion, wherein the elongate portion may extend through the body member and at least one of the first sealing member and second sealing member. The first sealing member, the body member and the second sealing member together may substantially seal a nozzle. The apparatus is also known as a reusable cap for caulking tubes.

The present disclosure further provides a reusable sealing apparatus for use with a container of an extractable material, the container including a nozzle. The apparatus may include a core member including a rod, the rod including an insertion tip and an elongate portion and a body member including a cavity configured to fit over a portion of the distal end of the nozzle and a substantially flat apex region defining an annular disk in sliding contact with the elongate portion. The apparatus may further include a first sealing member in sliding contact with the elongate portion, wherein the first sealing member may be compressible between a portion of the distal end of the nozzle and the annular disk such that the first sealing member and the annular disk together substantially seal the container.

The present disclosure further provides a reusable sealing apparatus for use with a container of an extractable material. The apparatus may include a conical body including a relatively flat apex region defining an annular disk and a first elastic annular seal sized to correspond to the annular disk and including a first hole. The apparatus may further include a second elastic annular seal that may be sized to correspond to the annular disk and including a second hole and an elongate rod that may be sized to fit sealingly through the first hole and the second hole, wherein the first annular seal, the annular disk, and the second annular seal are mounted on the elongate rod so that the annular disk is sandwiched between the first annular seal and the second annular seal.

DETAILED DESCRIPTION

Figure 1:
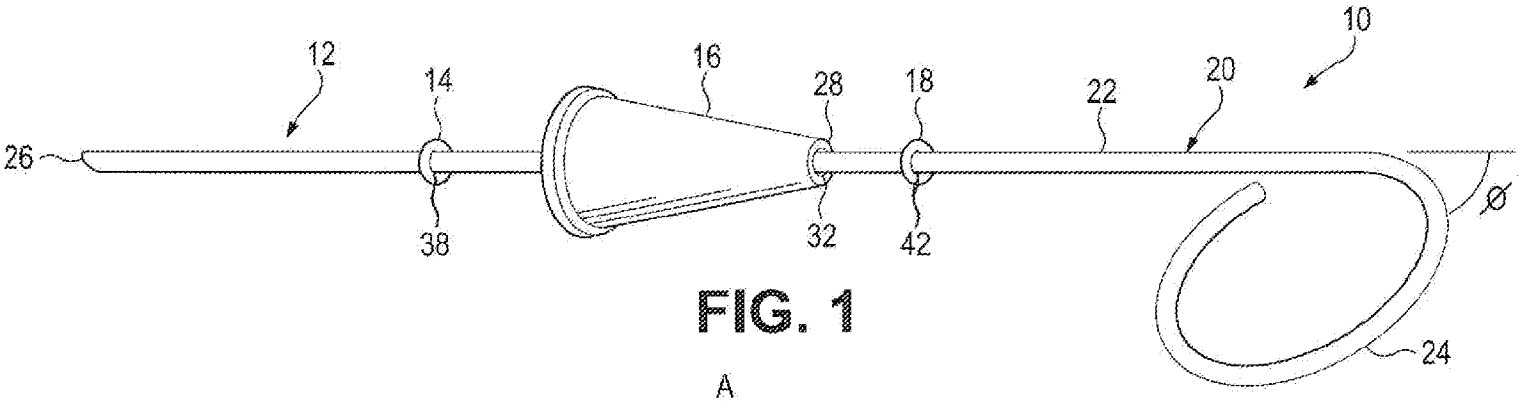
FIG. 1 is a top perspective view of a reusable sealing apparatus, showing a core member, a first sealing member, a body member and a second sealing member in accordance with the present disclosure.
Figure 2:
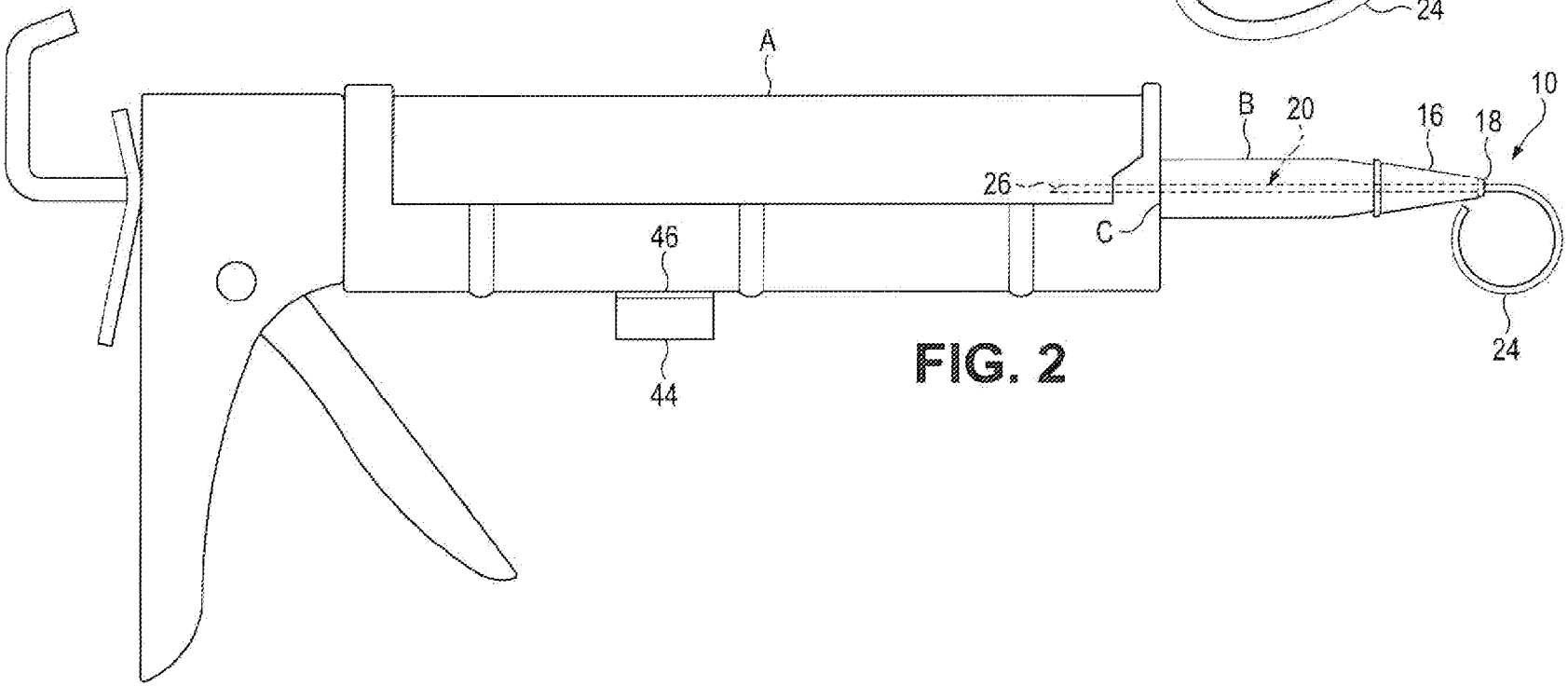
FIG. 2 is a side view of the reusable sealing apparatus of FIG. 1, showing a portion of the core member inserted into a nozzle of a container to seal the container, in accordance with the present disclosure.
Figure 4:
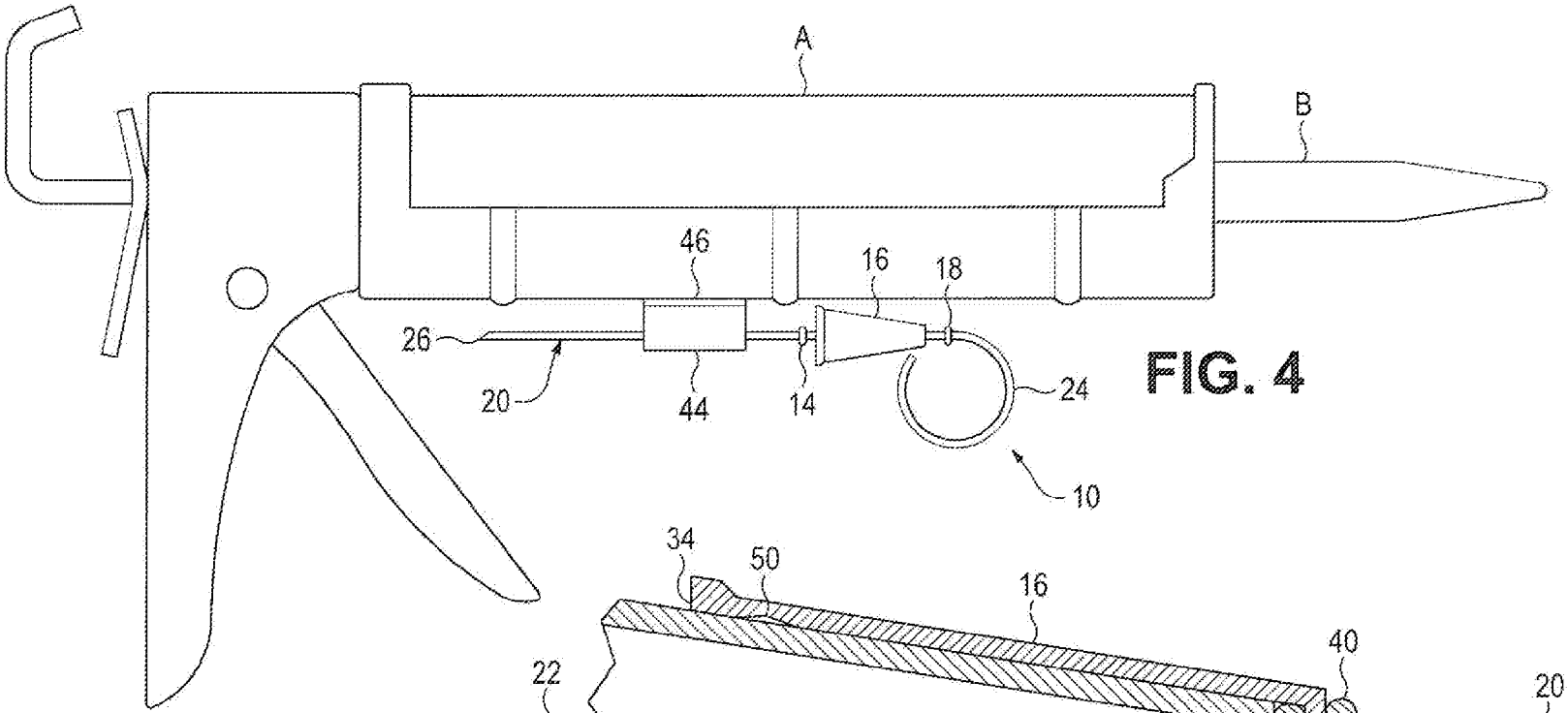
FIG. 4 is a side view of a reusable sealing apparatus removably held by a holder member on a side of a container in accordance with the present disclosure.
Figure 3:
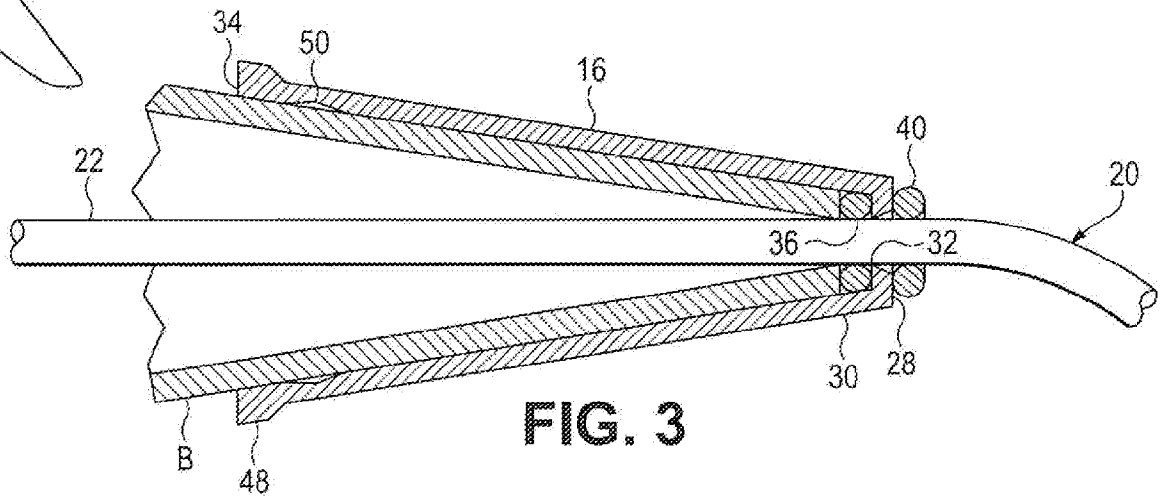
FIG. 3 is a partial cross-sectional view of the reusable sealing apparatus and the container of FIG. 2 in accordance with the present disclosure.

In accordance with the present disclosure, a reusable sealing apparatus, indicated generally at 10 in FIGS. 1-4, is provided to substantially seal a container A having a nozzle B, as shown in FIGS. 2-4. As described in further detail below, reusable sealing apparatus 10 may be further configured to puncture a seal C provided between a main portion of the container A and the base of the hollow nozzle B.

As shown in FIGS. 2-3, container A having nozzle B may include a caulking gun. Additionally and/or alternatively, reusable sealing apparatus 10 may be used in conjunction with a wide variety of containers or dispensing devices, both with and without nozzles, including caulking guns, grease guns, as well as dispensers for other viscous materials, including foodstuffs. Exemplary extractable material may include viscous materials such as adhesives, epoxies, sealants, including caulking, pastes, lubricants, and other viscous materials.

Turning now to FIG. 1, reusable sealing apparatus 10 may include a core member 12, a first sealing member 14, a body member 16 and/or a second sealing member 18. Core member 12 may include a rod 20 having an elongate portion 22. Elongate portion 22 may include a substantially uniform diameter extending along elongate portion 22 and may be sized to fit within an opening in the container A, for example an opening at the top of nozzle B. Rod 20 may further include a handle 24 having an angle of curvature ø that may be graspable by a user. The diameter of all or a portion of handle 24 may have the same diameter as elongate portion 22.

Elongate portion 22 may extend between an insertion tip 26 and handle 24 and may be of sufficient length such that insertion tip 26 may be able to reach seal C. Insertion tip 26 may be sufficiently resilient and/or otherwise configured to pierce or puncture seal C of an unused container A (FIG. 3). Additionally and/or alternatively, insertion tip 26 may be sufficiently resilient and/or otherwise configured to clear the nozzle B if the nozzle B is blocked or clogged with dried extractable material. Insertion tip 26 in FIGS. 1-3 is shown as pointed, however, insertion tip 26 may also be substantially flat or otherwise configured such that insertion tip 26 is not capable of piercing a user's skin. All or some of core member 12, including insertion tip 26, elongate portion 22 and/or handle 24 may be manufactured from a single metal wire, for example a steel wire, however other materials may be used.

Core member 12 may extend through body member 16. For example, core member 12 may extend through an annular disk 28 defined by an apex region 30 of body member 16 (FIG. 3). Annular disk 28 may include a relatively flat top side, generally facing away from body member 16 and/or a relatively flat bottom side, generally facing towards body member 16. An inner circumference 32 of annular disk 28 may engage or contact elongate portion 22 of rod 20. For example, inner circumference 32 may be slidingly mounted to elongate portion 22 such that body member 16 may be moveable along a length of core member 12.

Body member 16 may further include a cavity 34 configured to fit over a portion of the distal end of the nozzle B. For example, cavity 34 may be conical in shape and may include a substantially smooth inner surface. Alternatively, the interior surface of cavity 34 may be threaded. The exterior body shape of body member 16 may also be conical. Part or all of body member 16 may include a molded plastic material, however, other material known to those skilled in the art may be included.

First sealing member 14 may be mounted to core member 12 and may be configured to substantially seal the nozzle B in combination with core member 12 and/or body member 16. For example, first sealing member 14 may include a first elastic annular seal 36 sized to correspond to annular disk 28 and may include a first hole 38. First hole 38 may be sized to fit sealingly around core member 12 and/or may be slidingly mounted to core member 12 such that first sealing member 14 may be selectively positionable along core member 12. For example, as shown in FIG. 3, first sealing member 14 may be positioned against the bottom side of annular disk 28, such that first sealing member 14 may be sandwiched between the nozzle B and annular disk 28.

Second sealing member 18 may be mounted to core member 12 and may be configured to substantially seal the nozzle B in combination with core member 12 and body member 16. Additionally and/or alternatively, second sealing member 18 may be configured to substantially seal the nozzle B in combination with one or more of core member 12, body member and first sealing member 14. For example, second sealing member 18 may include a second elastic annular seal 40 sized to correspond to annular disk 28 and may include a second hole 42. Second hole 42 may be sized to fit sealingly around core member 12 and/or may be slidingly mounted to core member 12 such that second sealing member 18 may be selectively positionable along core member 12. For example, as shown in FIGS. 2 and 3, second sealing member 18 may be positioned against the top side of annular disk 28, such that annular disk 28 may be sandwiched between first sealing member 14 and second sealing member 18.

As shown in FIGS. 2 and 4, some embodiments of reusable sealing apparatus 10 may include a holder 44 configured to releasably retain core member 12. Holder 44 may include a substantially planar adhesive side 46 configured to adhere to the container A. Additionally and/or alternatively, other means known to those skilled in the art may be used to attach holder 44 to the container A.

Special details of body member 16 are shown in FIG. 3, including a raised external grip 48 adjacent the main opening into cavity 34, and an internal channel 50, slightly inset toward annular disk 28, relative to external grip 48. External grip 48 provides a convenient surface protruding from body member 16, typically used with a thumb and forefinger when pushing body member 16 firmly onto a nozzle of a container to seal the container. External grip 48 preferably is formed at a base region, distal from the apex region.

Internal channel 50 may be configured as an alternative and/or additional sealing means. For example, the nozzle B may include a protruding circular lip (not shown) extending around a circumference of nozzle B. Internal channel 50 may be configured to snap-fit over the circular lip of nozzle B or otherwise releasably retain a portion of the nozzle B within internal channel 50.

In use, a user may cut away a portion of the nozzle B tip to create an opening to dispense the extractable material. The tip may be cut in a flat or angled manner, depending on the preference of the user, to create the opening. The user may insert insertion tip 26 and at least a part of elongate portion 22 of core member 12 into the nozzle B to pierce seal C through the opening. The user may remove reusable sealing apparatus 10 from container A until the container A is ready for storage.

When the container A is ready for storage, the user may insert insertion tip 26 and at least a part of elongate portion 22 of reusable sealing apparatus 10 into the nozzle B. The nozzle B may engage one or more of first sealing member 14, body member 16 and second sealing member 18 to substantially seal the container A. For example, the nozzle B may engage first sealing member 14 such that first sealing member 14 abuts the bottom side of annular disk 28 and the top side of annular disk 28 may abut second sealing member 18. Internal channel 50 may be releasably snap-fitted over the circular lip (not shown) of the nozzle B. Reusable sealing apparatus 10 may substantially prevent the extractable material in the container A from drying out for a period of time, for example six months.

While the present description has been provided with reference to the foregoing embodiments, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring, nor excluding, two or more such elements.

What is claimed is:

1. A reusable sealing apparatus for use with a container of an extractable material, the container including a nozzle, the apparatus comprising:

a first sealing member;

a second sealing member;

a body member including a cavity configured to fit over a portion of a distal end of the nozzle, the body member positioned between the first sealing member and the second sealing member; and a core member including an insertion tip and an elongate portion, wherein the elongate portion extends through the body member and at least one of the first sealing member and second sealing member, wherein the first sealing member, the body member and the second sealing member are mounted on the elongate portion so that the body member can be sandwiched between the first sealing member and the second sealing member, and in combination substantially seal the nozzle.

2. The reusable sealing apparatus of claim 1, wherein at least one of the first sealing member, the second sealing member and the body member is slidingly moveable along the elongate portion.

3. The reusable sealing apparatus of claim 1, wherein the body member includes an annular disk in sliding contact with the elongate portion.

4. The reusable sealing apparatus of claim 1, wherein the core member includes a handle portion distal the insertion tip.

5. The reusable sealing apparatus of claim 4, wherein the handle portion extends from the elongate portion and includes a graspable angle of curvature.

6. The reusable sealing apparatus of claim 5, wherein the core member includes a rod having a substantially uniform diameter along at least the elongate portion and the handle portion.

7. The reusable sealing apparatus of claim 1, wherein at least one of the first sealing member and the second sealing member includes an o-ring.

8. The reusable sealing apparatus of claim 1, further comprising a holder member configured to releasably retain the core member.

9. The reusable sealing apparatus of claim 8, wherein the holder member includes a substantially planar adhesive side configured to adhere to the container.

10. The reusable sealing apparatus of claim 1, wherein the body member further includes an internal channel formed within the cavity.

11. A reusable sealing apparatus for use with a container of an extractable material, the container including a nozzle, the apparatus comprising:

a core member including a rod, the rod including an insertion tip and an elongate portion;

a body member including a cavity configured to fit over a portion of the distal end of the nozzle and a substantially flat apex region defining an annular disk in sliding contact with the elongate portion; and a first sealing member in sliding contact with the elongate portion;

wherein the first sealing member is compressible between a portion of the distal end of the nozzle and the annular disk such that the first sealing member and the annular disk together substantially seal the container.

12. The reusable sealing apparatus of claim 11, further comprising a second sealing member distal the first sealing member such that the annular disk is sandwiched between the first sealing member and the second sealing member, the second sealing member in sliding contact with the elongate portion.

13. The reusable sealing apparatus of claim 12, wherein the core member includes a handle portion distal the insertion tip.

14. The reusable sealing apparatus of claim 13, wherein the handle portion extends from the elongate portion and includes a graspable angle of curvature.

15. The reusable sealing apparatus of claim 14, wherein the core member includes a rod having a substantially uniform diameter along at least the elongate portion and the handle portion.

16. The reusable sealing apparatus of claim 11, wherein at least one of the first sealing member and the second sealing member includes an o-ring.

17. The reusable sealing apparatus of claim 11, further comprising a holder member configured to releasably retain the core member.

18. The reusable sealing apparatus of claim 17, wherein the holder member includes a substantially planar adhesive side configured to adhere to the container.

19. A reusable sealing apparatus for use with a container of an extractable material, the apparatus comprising:

a conical body including a relatively flat apex region defining an annular disk;

a first elastic annular seal sized to correspond to the annular disk and including a first hole;

a second elastic annular seal sized to correspond to the annular disk and including a second hole; and an elongate rod sized to fit sealingly through the first hole and the second hole;

wherein the first annular seal, the annular disk, and the second annular seal are mounted on the elongate rod so that the annular disk is sandwiched between the first annular seal and the second annular seal.

20. The reusable sealing apparatus of claim 19, wherein the conical body further includes a base region distal from the apex region and an internal channel slightly inset toward the annular disk, relative to the base region.

* * * * *